US007175552B2

(12) United States Patent
Fritzke et al.

(10) Patent No.: US 7,175,552 B2
(45) Date of Patent: Feb. 13, 2007

(54) BALL BAT FORMED OF CARBURIZED STEEL

(75) Inventors: Mark A. Fritzke, Portland, OR (US); Bradley L. Gaff, Portland, OR (US); Douglas G. Guenther, Wheaton, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 10/894,622

(22) Filed: Jul. 20, 2004

(65) Prior Publication Data

US 2006/0019779 A1 Jan. 26, 2006

(51) Int. Cl.
*A63B 59/06* (2006.01)

(52) U.S. Cl. ..... 473/566; 473/567

(58) Field of Classification Search ..... 473/564–568, 473/457, 519, 520

See application file for complete search history.

(56) References Cited

U.S. PATENT DOCUMENTS

| | | | | | |
|---|---|---|---|---|---|
| 1,611,858 | A | * | 12/1926 | Middlekauff | 473/566 |
| 3,861,682 | A | | 1/1975 | Fujii | 273/72 A |
| 3,876,204 | A | | 4/1975 | Moore et al. | 273/72 A |
| 3,963,239 | A | | 6/1976 | Fujii | 273/72 A |
| 4,555,326 | A | * | 11/1985 | Reid | 208/48 R |
| 4,569,521 | A | | 2/1986 | Mueller | 273/72 A |
| 4,600,193 | A | | 7/1986 | Merritt | 273/72 A |
| 4,720,104 | A | | 1/1988 | DiSieno | 273/67 R |
| 5,104,123 | A | | 4/1992 | Okitsu et al. | 273/72 A |
| 5,364,095 | A | | 11/1994 | Easton et al. | 273/72 A |
| 5,415,398 | A | | 5/1995 | Eggiman | 273/72 A |
| 5,455,068 | A | * | 10/1995 | Aves et al. | 427/237 |
| 5,458,330 | A | | 10/1995 | Baum | 273/72 A |
| 5,511,777 | A | | 4/1996 | McNeely | 273/72 A |
| 5,722,908 | A | | 3/1998 | Feeney et al. | 473/567 |
| 5,961,405 | A | * | 10/1999 | MacKay, Jr. | 473/566 |
| 6,053,828 | A | | 4/2000 | Pitsenberger | 473/566 |
| 6,143,429 | A | | 11/2000 | Abkowitz et al. | 428/651 |
| 6,176,795 | B1 | | 1/2001 | Schullstrom | 473/566 |
| 6,302,813 | B1 | | 10/2001 | Sturgeon et al. | 473/564 |
| 6,344,007 | B1 | * | 2/2002 | Feeney et al. | 473/567 |
| 6,383,100 | B2 | * | 5/2002 | Pitsenberger et al. | 473/566 |
| 6,482,114 | B1 | | 11/2002 | Eggiman et al. | 473/566 |
| 6,485,382 | B1 | * | 11/2002 | Chen | 473/566 |
| 6,497,772 | B1 | * | 12/2002 | Meckel et al. | 148/254 |
| 6,949,038 | B2 | * | 9/2005 | Fritzke | 473/566 |
| 2002/0094892 | A1 | * | 7/2002 | Chauvin et al. | 473/566 |
| 2002/0183142 | A1 | * | 12/2002 | Higginbotham | 473/564 |
| 2003/0226625 | A1 | * | 12/2003 | Kuehmann et al. | 148/621 |

* cited by examiner

*Primary Examiner*—Mark S. Graham
(74) *Attorney, Agent, or Firm*—Terence P. O'Brien

(57) ABSTRACT

A ball bat includes a substantially tubular frame having a handle portion and a primary hitting portion. The handle portion is formed of a non-steel material. The hitting portion is formed separately from, and coupled to, the handle portion. The hitting portion is formed of a steel and has an inner surface and an outer surface. At least a portion of hitting portion is carburized forming a carburized layer.

27 Claims, 8 Drawing Sheets

BALL BAT FORMED OF CARBURIZED STEEL

FIELD OF THE INVENTION

The present invention relates generally to ball bats. In particular, the present invention relates to a ball bat formed of conventional carbon steel, alloy steel or high strength low alloy steel wherein at least portion of such steel used to form the bat is strengthened through carburization, nitriding, or boriding.

BACKGROUND OF THE INVENTION

Ball bats, such as baseball and softball bats, are well known. In recent years, metallic bats including a tubular handle portion and a tubular hitting portion have emerged providing improved performance and improved durability over crack-prone wooden bats. The most common tubular bat is the aluminum single-wall tubular bat. Such bats have the advantage of a generally good impact response, meaning that the bat effectively transfers power to a batted ball.

Generally speaking, bat performance is a function of the weight of the bat, the size, and the impact response of the bat. The durability of a bat relates, at least in part, to its ability to resist denting and depends on the strength and stiffness of the tubular bat frame. While recent innovations in bat technology have increased performance and durability, most new bat designs typically improve performance or durability at the expense of the other because of competing design factors. For example, an attempt to increase the durability of the bat often produces an adverse effect on the bat's performance.

The incorporation of these advances and the use of additional materials, such as, other aluminum alloys, titanium alloys and composite materials have resulted in a large variety of well-performing ball bats. Despite such advances in ball bat design and materials, a continuing need exists to further improve the performance, durability and feel of existing bats.

One drawback of recent ball bats formed of aluminum, titanium or composite materials is their cost. Aluminum, titanium and composite materials generally have a high material cost. For example, aluminum can cost up to ten times the price of conventional steel, and titanium is significantly more expensive than aluminum. Further, many metals, such as titanium, are difficult to work with, having very poor workability. Also, the manufacturing costs for composite materials are also relatively high. Still further, the availability of many metals, including titanium, is often variable, making obtaining a consistent supply of material at a generally consistent price difficult. For these reasons, the use of titanium is fairly limited in current bat designs. Aluminum is most commonly used in non-wooden ball bats because of its low material density (lightweight) and its high workability. However, the tensile strength aluminum is generally approximately 85 ksi, which is significantly lower than many other metals. In order to provide sufficient strength and durability, aluminum bats are often formed with a wall thickness as high as 0.110 inches.

Although conventional steel is significantly cheaper and tougher than aluminum or titanium and has relatively high workability, conventional steel is typically not used to form ball bats due to its relatively high weight or density. Further, although conventional steel, after heat treating, has a tensile strength (typically approximately 150 ksi or less), which is greater than aluminum, the wall thickness required to produce a bat formed of conventional steel that is sufficiently durable for competitive play results in a bat that is too heavy for most ball players. Use of heavy materials can negatively affect a player's bat speed and the moment of inertia ("MOI") of the bat. High quality steels, such as maraging steels, provide a higher tensile strength. However, such high quality steels, are very expensive and difficult to work with, resulting in high material and manufacturing costs.

Thus, a continuing need exists for a ball bat that provides improved performance and high durability at a reasonable cost. It would be advantageous to provide a high performance ball bat that meets all the requirements of conventional play including weight, without excessive material costs or excessive manufacturing costs. What is needed is a ball bat that incorporates and improves on the beneficial material properties and qualities of steel while addressing potentially negative characteristics related to the use of steel, including the weight distribution and MOI of the bat.

SUMMARY OF THE INVENTION

The present invention provides a ball bat configured for impacting a ball. The bat includes a substantially tubular frame having a handle portion and a hitting portion. The handle portion is formed of a non-steel material. The hitting portion is formed separately from, and coupled to, the handle portion. The hitting portion is formed of a steel and has an inner surface and an outer surface. At least a portion of hitting portion is carburized forming a carburized layer.

According to a principal aspect of the invention, a bat has a longitudinal axis and is capable of being tested in a ring load testing device having first and second platens. The bat includes a substantially tubular frame having a handle portion and a primary hitting portion. The hitting portion is formed of a conventional carbon steel or a high strength, low alloy steel. The hitting portion has a central region with a wall thickness within the range of 0.040 to 0.065 inches. The hitting portion has a yield strength within the range of 200 and 300 ksi, when measured in the ring load testing device. A ring of a predetermined length is removed from the central region of the hitting portion and is placed between the first and second platens of the ring load testing device. The first platen applies a load to an outer circumferential surface of the ring in a direction that is substantially perpendicular to the longitudinal axis, from which load deflection data is obtained.

According to another principal aspect of the invention, a ball bat includes a substantially tubular frame having a handle portion and a primary hitting portion. The hitting portion is formed of a steel. The hitting portion has a first wall thickness, an inner surface and an outer surface. At least a portion of hitting portion includes a high performance layer. The high performance layer has a hardness within the range of 80 to 93 on a 15N Rockwell Hardness Scale. The high performance layer has a second thickness that is sized to be at least 5% of the first wall thickness.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
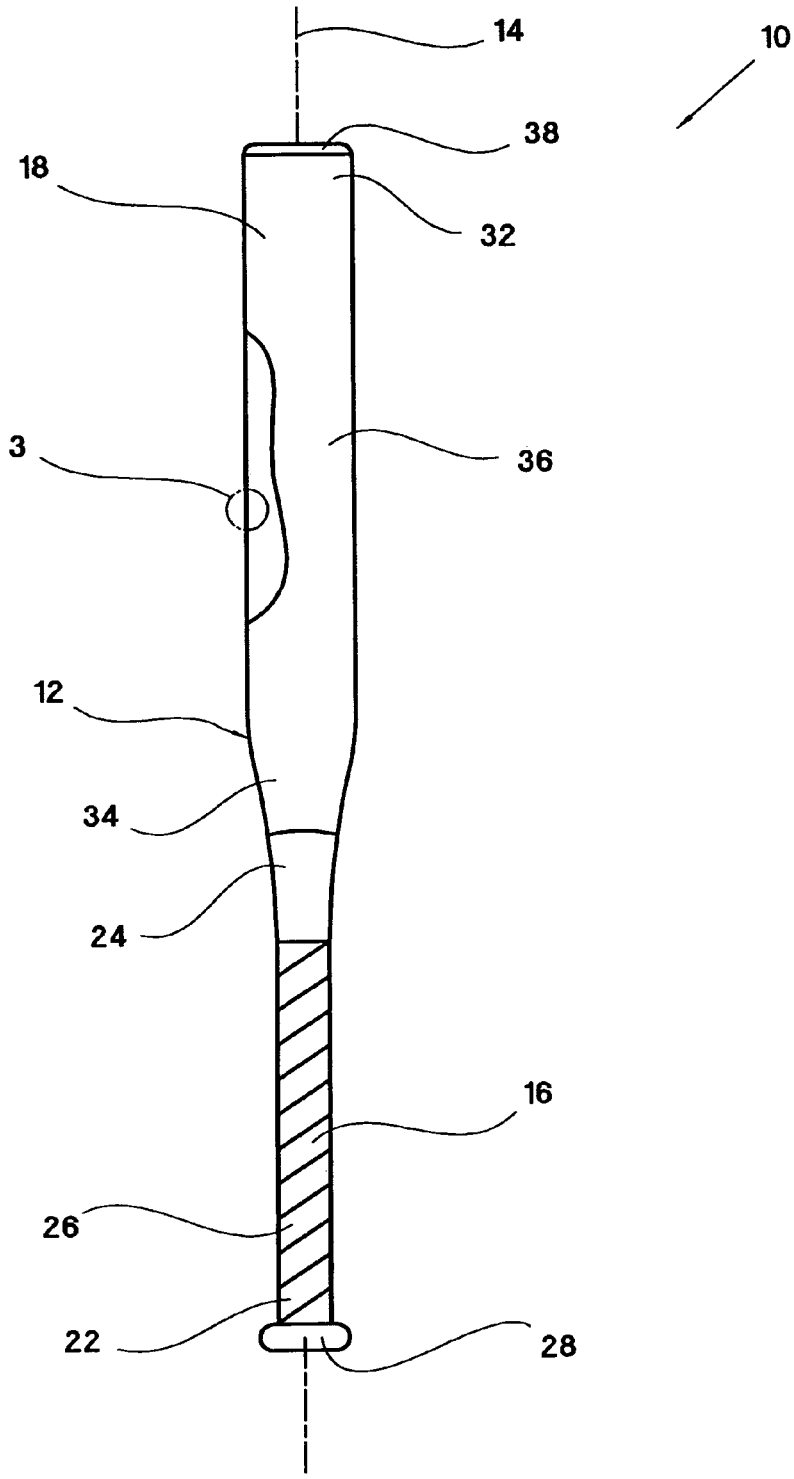
FIG. 1 is a side view of a bat in accordance with a preferred embodiment of the present invention, wherein a section of a hitting portion of a frame of the bat is removed.

Referring to FIG. 1, a ball bat is indicated generally at 10. The ball bat 10 of FIG. 1 is configured as a softball bat; however, the invention can also be formed as a baseball bat, a rubber ball bat, or other form of ball bat. The bat 10 includes a frame 12 extending along a longitudinal axis 14 and has a relatively small diameter handle portion 16, and a relatively larger diameter hitting or impact portion 18, and an intermediate tapered portion that extends between the handle and impact portions 14 and 16. Alternatively, the hitting portion can encompass some or all of the tapered portion.

Figure 2:
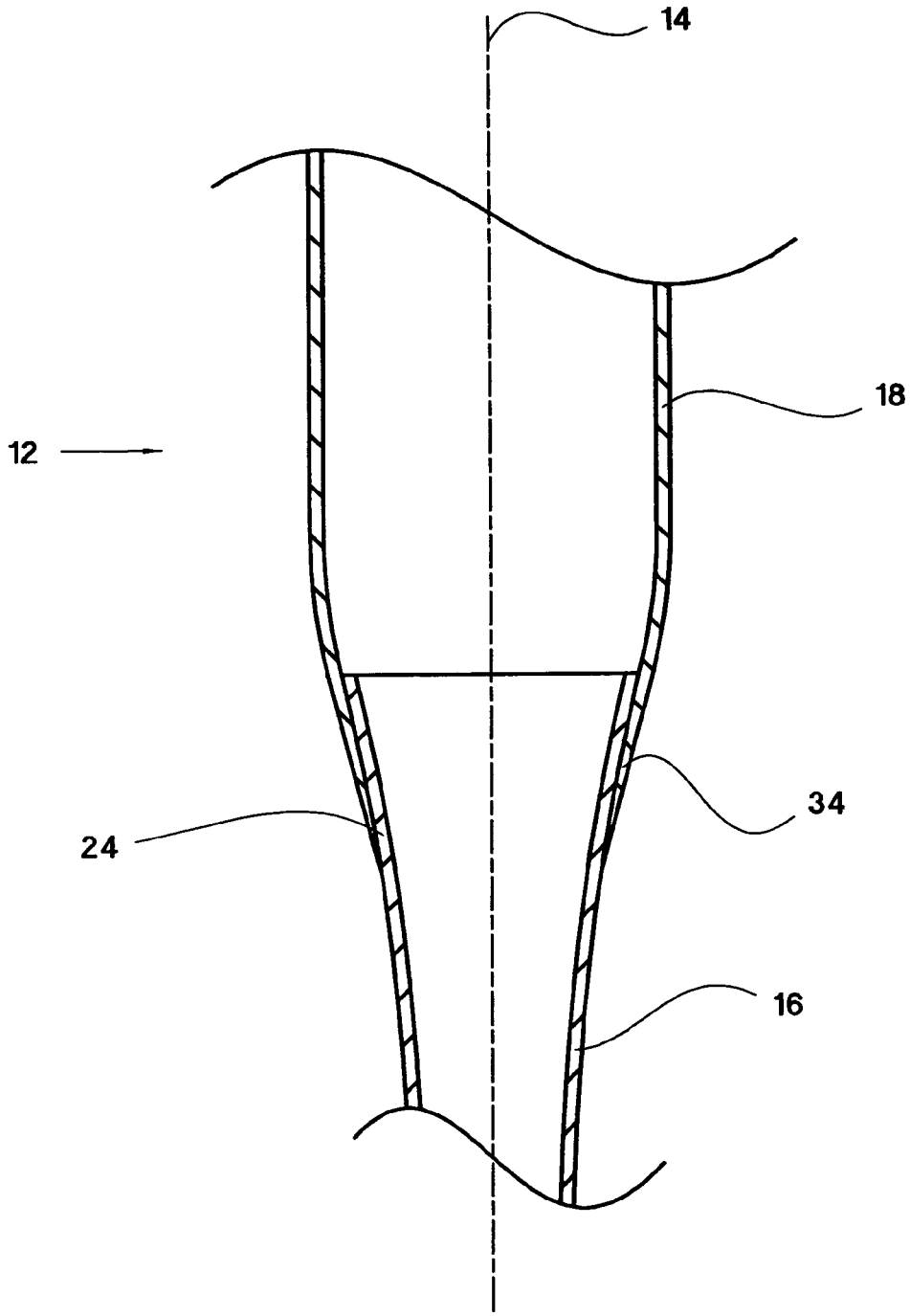
FIG. 2 is a longitudinal cross-sectional view of the bat of FIG. 1 illustrating separate handle and hitting portions of the bat.

Referring to FIGS. 1 and 2, the handle and hitting portions 16 and 18 of the frame 12 are formed as separate structures, which are connected or coupled together. This multi-piece frame construction enables the handle portion 16 to be formed of one material, and the hitting portion 18 to be formed of a second, different material.

The handle portion 16 is an elongate structure extending along the axis 14. The handle portion 16 has a proximal end region 22 and a distal end region 24, which extends along, and diverges outwardly from, the axis 14 outwardly projecting from and along the axis 14 to form a substantially frusto-conical shape for connecting or coupling to the hitting portion 18. Preferably, the handle portion 16 is sized for gripping by the user and includes a grip 26 wrapped around and extending longitudinally along the handle portion 16, and a knob 28 connected to the proximal end 22 of the handle portion 16. The handle member 16 is formed of a strong, flexible, lightweight material, preferably a composite material. Alternatively, the handle portion 16 can be formed of other materials such as aluminum or wood. In other alternative embodiments, heavier materials such as other metals and steels can be used.

The hitting portion 18 of the frame 12 is "tubular," "generally tubular," or "substantially tubular," each terms intended to encompass softball style bats having a substantially cylindrical impact portion (or "barrel") as well as baseball style bats having a generally frusto-conical barrel. The hitting portion extends along the axis 14 and has a distal end region 32, a proximal end region 34, and a central region 36 disposed between the distal and proximal end regions 32 and 34. The proximal end region 34 converges toward the axis 14 in a direction toward the proximal end of the hitting portion 18 to form a frusto-conical shape that is complementary to the shape of the distal end region 24 of the handle portion 16. The hitting portion 18 can be directly connected to the handle portion. The connection can involve a portion of, or substantially all of, the distal end region 24 of the handle portion 16 and the proximal end region 34 of the hitting portion 18. Alternatively, an intermediate member can be used to separate and/or attach the handle portion 16 to the hitting portion 18. The intermediate member can space apart all or a portion of the hitting portion 16 from the handle portion 16, and it can be formed of an elastomeric material, an epoxy, an adhesive, a plastic or any conventional spacer material. The bat 10 further includes an end cap 38 attached to the distal end 32 of the hitting portion 18 to substantially enclose the distal end 32.

The tubular frame 12 can be sized to meet the needs of a specific player, a specific application, or any other related need. The frame 12 can be sized in a variety of different weights, lengths and diameters to meet such needs. For example, the weight of the frame 12 can be formed within the range of 15 ounces to 36 ounces, the length of the frame can be formed within the range of 24 to 36 inches, and the maximum diameter of the hitting portion 18 can range from 1.5 to 3.5 inches.

Unlike existing ball bats, which are typically formed of aluminum, titanium, wood, or a composite material, the present invention is directed toward the use of steel to form the hitting portion 18 of the ball bat. The steel bat of the present invention provides exceptional performance at a very reasonable price. Aluminum, titanium and composite materials all have drawbacks. Aluminum is lightweight and has good workability, but can be quite expensive, as much as ten times the cost of conventional steel, and the yield strength is lower than titanium or heat treated steel. Because the performance of a bat is directly related to the toughness and strength of the bat material, the thickness of the hitting portion 18 must be greater for aluminum than for other higher strength materials. As a result, more aluminum is required to construct a bat. Titanium has a very high yield strength and is lighter than steel, but titanium is very expensive (with a much higher cost than aluminum), and it has very low workability making it hard to swage or form into the desired shape. Composite materials are lightweight and can be formed to a desired strength, but the material and manufacturing costs can be quite high.

The hitting portions of existing ball bats are not formed of steel because (1) the density (and the corresponding weight) of steel is quite high (approximately 3 times the density of aluminum and twice the density of titanium), and (2) because untreated steels have very low yield strengths. Premium steels, such as, for example, maraging steels, high carbon content steels, and other high alloy content steels, can provide a very high yield strength, however, these materials also very expensive and provide very low workability.

The present invention overcomes these drawbacks by forming a ball bat using carburized and tempered steel. More specifically, at least a portion of the hitting portion 18 of the bat 10 is formed of a conventional carbon steel, an alloy steel or a high strength low alloy steel, which is carburized and tempered to produce a hitting portion 18 that provides exceptional performance at a very reasonable price. Conventional carbon steels, alloy steels and high strength low alloy steels (hereinafter referred to as "Conventional Steels") are generally significantly less expensive (often less than $1 per lb.) than other materials such as aluminum (often approximately $10 per lb.), titanium, premium steels and composites. Conventional Steels also provide exceptional workability, ductility and toughness.

Untreated Conventional Steels however have a low yield strength (approximately 30 ksi compared to aluminum with a yield strength of approximately 85 ksi,), in addition to a high density as mentioned above. Higher strength materials are desirable in the construction of ball bats because a higher strength material can be formed with a thinner tubular wall thickness without denting, or plastically deforming, upon impact with a ball during play. Higher strength materials also tend to flex more, thereby providing more of a "trampoline" type effect to the bat, upon impact with a ball. The thinner walls achieved through the use of a high strength material require less material to form the bat. However, high strength cannot be achieved at the expense of ductility. A high strength material having low ductility can become brittle and prone to brittle failure or fracture modes. Such failure modes are undesirable since they can result in cracking or shattering of the ball bat raising safety issues.

Heat treating Conventional Steels increases the yield strength of Conventional Steels to approximately 150 ksi. However, due to the high density of Conventional Steels, the yield strength of heat-treated Conventional Steels is insufficient to enable the wall thickness of the hitting portion of the bat to be reduced to a viable level. The wall thickness required for a heat treated Conventional Steel bat would result in a bat that exceeds all desired weight ranges for conventional play.

The present invention overcomes these obstacles by carburizing at least a portion of the hitting portion 18 of the bat 10. The carburization of the Conventional Steel significantly increases the micro-hardness and the yield strength of the hitting portion when measured in a ring load test as described below. Carburizing Conventional Steels can increase the yield strength of the hitting portion of the bat up to as high as 300 ksi. Carburization can also be applied to Conventional Steels without significantly decreasing the ductility and toughness of the material. The high strength and high ductility achieved through carburization enables Conventional Steels to be used in ball bat applications without causing the bat to fall outside of conventional design characteristics, such as bat weight.

Carburization is a metallurgical process whereby carbon is added or impregnated into a material, such as a Conventional Steel, beginning on the surface or surfaces of the Conventional Steel that are exposed to the carbon. Carburization involves heating the bat 10, or a portion of the bat 10, in a furnace (or other conventional apparatus) and then introducing a carbon rich atmosphere into the furnace. Variables such as furnace temperature, furnace time, the atmosphere including the carbon content, control the depth of penetration and the degree or percent of carbon content in the hitting portion 18 or the bat 10. After carburization, the bat 10 and/or hitting portion is quenched and then tempered to develop an optimum combination of hardness, strength and toughness.

Carburization is preferably performed on at least a portion of a bat 10 or a hitting portion of a bat after the bat has been formed and/or swaged into the desired shape, thereby enabling the Conventional Steel to be worked and formed when it possesses a very high workability. Because carburization can be performed on only a portion of the hitting portion 18, if desired, selectively applying carburization enables the bat to be formed with exceptional yield strength characteristics in the specific desired location(s).

Figure 3:
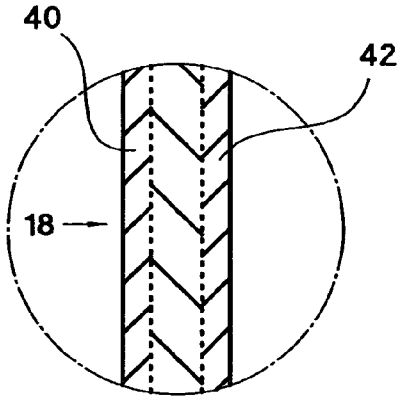
FIG. 3 is a cross-sectional view of a portion of the hitting portion of the bat taken from circle 3 of FIG. 1.

Referring to FIG. 3, in a preferred embodiment, carburization is applied to generally the entire hitting portion 18 including the inner and outer surfaces of the hitting portion. Carburization, also known as "case hardening," adds carbon through diffusion into the exposed surfaces of the hitting portion 18 thereby essentially forming a carburized layer beginning at the exposed surfaces and extending into the Conventional Steel of the hitting portion 18. In FIG. 3, the hitting portion 18 is formed with an outer carburized layer 40 and an inner carburized layer 42.

In alternative preferred embodiments, a stop-off coating, or other masking tool, can be used to prevent or inhibit the addition or diffusion of carbon into a portion of the exposed surface of the bat 10. One such stop-off coating is a Water-based Carburizing Stop-Off Coating supplied by Avion Manufacturing of Brunswick, Ohio. In one particularly preferred alternative embodiment, the stop-off coating can be applied to one or more of the distal and proximal end regions 32 and 34 of the hitting portion 18 thereby allowing for only the central region 36 to be carburized.

Figure 4:
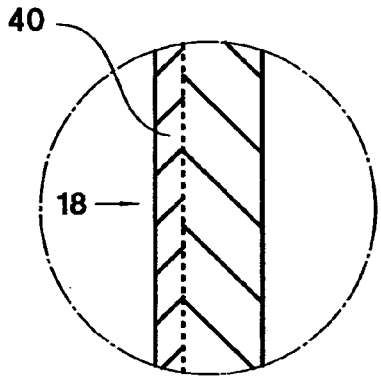
FIGS. 4–6 are cross-sectional views of a portion of the hitting portion of the bat taken from circle 4 of FIG. 1 in accordance with additional alternative preferred embodiments of the present invention.
Figure 5:
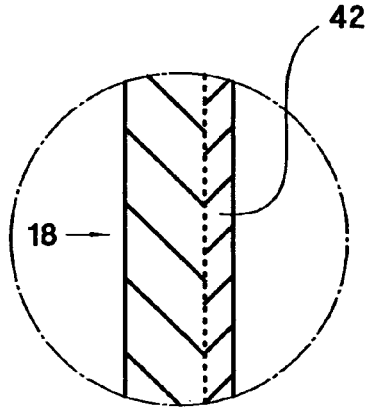
Figure 6:
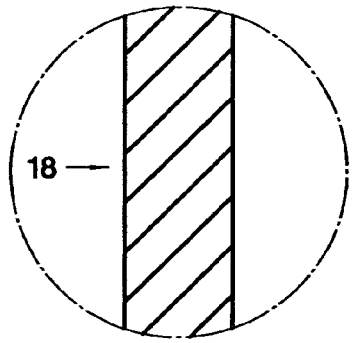

Referring to FIGS. 4 and 5, in other alternative preferred embodiments, the stop off coating can be used to limit the carburization to only the outer surface of the hitting portion 18 (FIG. 4) or to only the inner surface of the hitting portion 18 (FIG. 5). Referring to FIG. 6 in another alternative preferred embodiment, the hitting portion 18 can be carburized to the extent that carbon is diffused through the entire wall thickness of the hitting portion 18.

By varying the temperature, duration and carbon content used during the carburization process, the depth of penetration into the bat 10 or the hitting portion 18 can be varied. As shown in FIG. 6, carburization can extend through the entire thickness of the material, if desired.

The increased yield strength achieved through the carburization of Conventional Steels enables the wall thickness of the tubular hitting portion 18 to be significantly thinner than that of conventional aluminum bats. The wall thickness of the carburized Conventional Steel hitting portion 18 is preferably within 0.030 and 0.075 inch. In a particularly preferred embodiments, narrower ranges within the 0.030 and 0.075 inch range can be used. Table 1 illustrates the approximate wall thicknesses of hitting portions of single wall ball bats for conventional aluminum ball bats and carburized Conventional Steel bats for softball, youth baseball and adult baseball ball applications. The thinner walls require less Conventional Steel and result in less overall weight. Table 1 is an example only and is not intended to be a limit on the wall thickness of the carburized Conventional Steel bat.

TABLE 1

| Ball Bat Application | Approximate Wall Thickness of Hitting Portion of Conventional Aluminum Ball Bat (inches) | Approximate Wall Thickness of Hitting Portion of Carburized Conventional Steel Bat (inches) |
|---|---|---|
| Softball | 0.075 | 0.044 |
| Youth Baseball | 0.090 | 0.050 |
| Adult Baseball | 0.110 | 0.064 |

The use of higher strength carburized Conventional Steel allows for up to a 45% reduction in the wall thickness of a hitting portion of a bat over a conventional aluminum bat. As a result a thinner wall can be used for a hitting portion formed of carburized Conventional Steel, and, therefore, less carburized Conventional Steel is required and the weight can be reduced.

The thickness of the carburized layer, or the case depth of the carburization, can range from 0.002 inches up to the entire wall thickness of the hitting portion 18. In a particularly preferred embodiment, the thickness of the carburized layer of the hitting portion 18 is within the range of 0.010 to 0.020 inches. In another alternative preferred embodiment, the thickness of the carburized layer of the hitting portion 18 is within the range of 0.008 to 0.012 inch. Other preferred thickness ranges can also be used. By carburizing only the outer regions of the tubular wall, the ductility and toughness of the Convention Steel is maintained in the non-carburized regions of the hitting portion 18.

Forming a carburized layer at the outer and/or inner surfaces of the desired location of the hitting portion 18 introduces residual compressive stresses into the case hardened or carburized layer. These residual compressive stresses counter act applied tensile stresses, which occur upon impact with a ball. Since it is these applied tensile stresses that can lead to plastic deformation and cracking of the hitting portion 18, the residual compressive stresses improve the hitting portion's ability to withstand an impact with a ball.

The yield strength of the hitting portion 18 formed of carburized Conventional Steel increases to within the range of 200 to 300 ksi, as derived from the ring load test described below. In one particularly preferred embodiment, the yield strength of the carburized hitting portion 18 of the present invention is within the range of 218 to 278 ksi, as derived from the ring load test described below. In another particularly preferred embodiment, the yield strength of the carburized hitting portion 18 of the present invention is within the range of 262 to 278 ksi, as derived from the ring load test described below.

The localized hardness of the carburized hitting portion 18 of the present invention is typically within the range of 360 to 560 on a Knoop Hardness Scale ("HK") (wherein the applied load is >500 gf) or within the range of 78 to 86 on a Rockwell Superficial Hardness 15N Scale. In a particularly preferred embodiment, the localized hardness of the carburized hitting portion 18 is within the range of 400 to 505 on a Knoop Hardness Scale or within the range of 79 to 84 on a Rockwell Superficial Hardness 15N Scale.

The use of carburized Conventional Steel in a ball bat is further enabled by the separate handle and hitting portions 16 and 18 of FIGS. 1 and 2, because the separation of the handle portion 16 from the hitting portion 18 enables the handle portion 16 to be formed of a different material than the hitting portion 18. For example, in one preferred embodiment, the handle portion 16 is formed of a lightweight composite material. The bat 10 can be more easily configured to fall within the desired weights for ball bats when the Conventional Steel of the bat 10 is limited to the hitting region 18.

Figure 7:
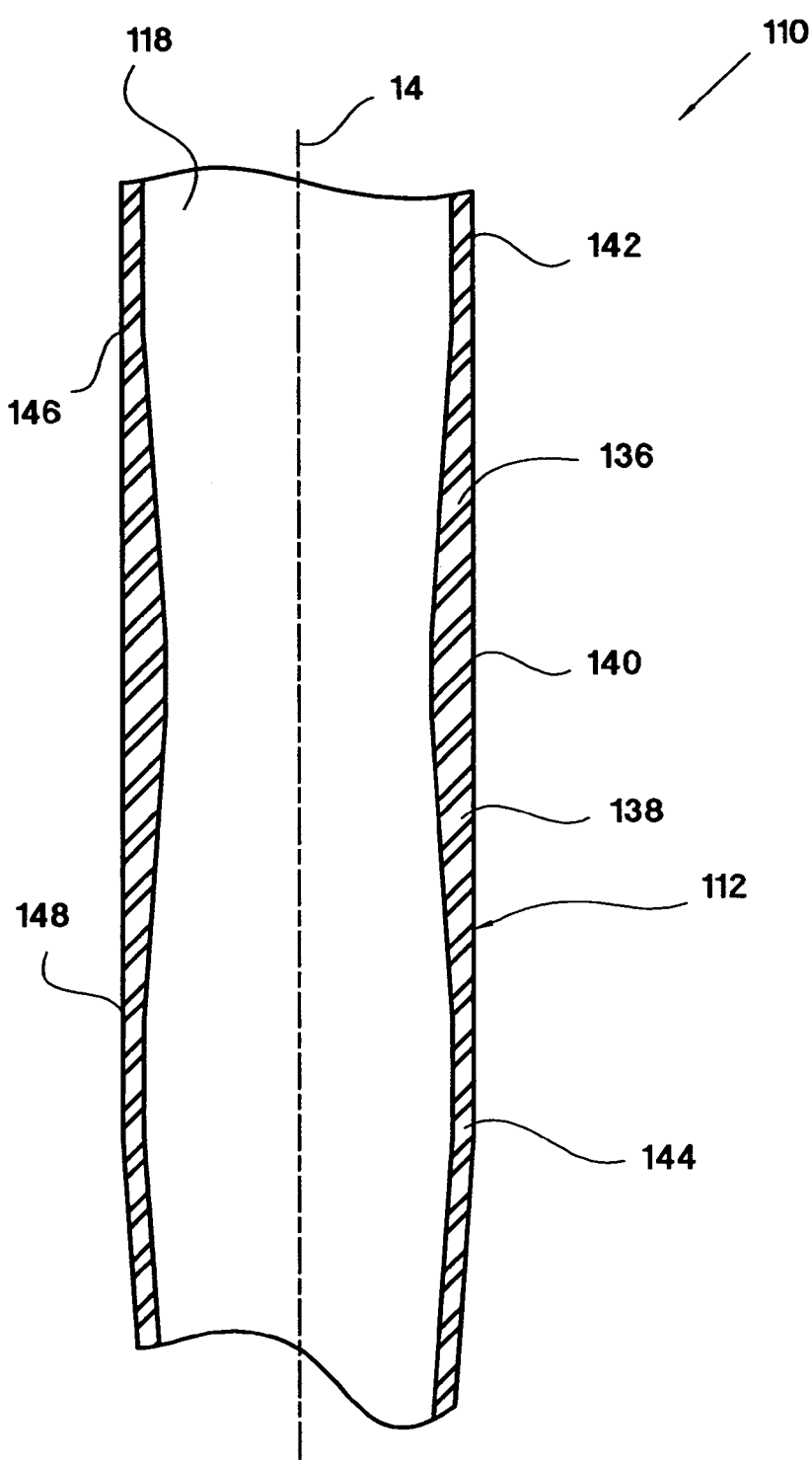
FIG. 7 is a longitudinal cross-sectional view of a hitting portion of a bat in accordance with another alternative preferred embodiment of the present invention, wherein the thickness of the hitting portion is exaggerated in order to highlight the variation in wall thickness of the hitting portion.

FIG. 7 illustrates an alternative preferred embodiment of the present invention in which a cross-sectional view of a hitting portion 118 of a ball bat 110 is enlarged to illustrate the variation in wall thickness along the longitudinal axis 14. The variable wall thickness of the hitting portion is described in U.S. patent application Ser. No. 10/781,244 filed on Feb. 18, 2004, which is incorporated by reference. Incorporating a variable wall thickness into the configuration of the hitting portion also further enables the use of carburized Conventional Steel to form the hitting portion 18, or a portion thereof.

The hitting portion 118 of the bat 110 includes first and second tubular wall transition regions 136 and 138, an intermediate tubular region 140, and distal and proximal tubular regions 142 and 144. The distal and proximal tubular regions 142 and 144 positioned adjacent a distal end of the bat 110 and the intermediate portion 110 of the frame 112, respectively. The intermediate tubular region 140 is positioned between the first and second tubular wall transition regions 136 and 138. The first transition region 136 is then positioned between the intermediate tubular region 140 and the distal tubular region 142, and the second transition region 138 is positioned between the intermediate tubular region 140 and the proximal tubular region 144.

The intermediate tubular region 140 is preferably centered about the sweet spot of the bat. The intermediate tubular region 140 preferably has a generally uniform wall thickness, which varies by less than or equal to 0.003 inch. The wall thickness of the hitting portion 118 is also preferably greatest at the intermediate tubular region 140. The generally uniform wall thickness of the intermediate tubular region 140 is within the range of 0.040 to 0.065 inch. In alternative preferred embodiments, the intermediate tubular region 140 can be formed of other thicknesses. The length of the intermediate tubular region 140 is preferably within the range of 0.25 to 9.0 inches. In a particularly preferred embodiment, the length of the intermediate tubular region 140 is within the range of 1.0 to 5.0 inches. In yet another alternative preferred embodiment, the hitting region can be formed without an intermediate tubular region.

Each of the first and second tubular wall transition regions 136 and 138 has a wall thickness that varies along the longitudinal axis 14. The first transition region 136 has a wall thickness that generally increases along the axis 14 from a first position 146, closest to the distal end of the bat 110, toward the handle portion. The second transition region 138 is preferably similar to the first transition region 136, but varies in thickness in a manner that is opposite, or symmetrical to, the first transition region 136. In particular, the wall thickness of the second transition region 138 generally increases along the longitudinal axis 14 from a second position 148, closest to the handle portion, toward the distal end. In a preferred embodiment, as shown in FIG. 7, the wall thickness of the first and second transition regions 136 and 138 varies generally linearly and generally uniformly along the longitudinal axis 14. In alternative preferred embodiments, the wall thickness of one or both of the first and second tubular wall transition regions can increase along its length in a manner that is non-linear, staggered, stepped, or a combination thereof. The variation in wall thickness of one or more of the first and second transition regions 136 and 138 along its length can vary within the range of 0.030 to 0.065 inch.

The length of each of the first and second tubular wall transition regions 136 and 138 is preferably within the range of 0.25 to 7.0 inches. In a preferred embodiment, the length of the first and second tubular wall transition regions 136 and 138 is within the range of 0.25 to 5.0 inches. In alternative preferred embodiments, the first and second tubular wall transition regions can have the same length or varying lengths.

The distal and proximal tubular regions 142 and 144 are preferably positioned at opposite ends of the hitting portion 118. The distal tubular region 142 is positioned at the distal end of the bat 110 and extends to the first tubular wall transition region 136, and the proximal tubular region 144 is positioned at the proximal end of the hitting portion 118 and extends to the second tubular wall transition region 138. The distal and proximal tubular regions 142 and 144 each preferably have a generally uniform wall thickness, which varies by less than or equal to 0.003 inch along its length. The generally uniform wall thickness of the distal and proximal tubular regions 142 and 144 region can be 0.030 inch or larger. In alternative preferred embodiments, other wall thicknesses can be used, and the wall thickness can vary between the distal and proximal tubular regions 142 and 144.

The length of the distal tubular region 142 is preferably within the range of 0.25 to 4.0 inches, and the length of the proximal tubular region 144 is preferably within the range of 2.0 to 6.0 inches. Other lengths, other thicknesses and combinations thereof are also contemplated under this invention.

In yet another alternative preferred embodiment, the hitting portion 118 can be formed with one or more additional tubular wall transition regions and/or one or more additional intermediate regions. In another alternative preferred embodiment, the additional wall thickness can be used at the distal end of the bat to add strength or weight to the distal end of the bat, and to provide additional support for an end cap. The wall thickness of the hitting portion 118 can be varied to compensate for the stiffness and/or softness of the end cap being used as well as for the tapered ends of the bat frame.

In a preferred embodiment the outer diameter of the hitting portion 118 is generally uniform along its length and the inner diameter of the hitting portion 118 varies along its length to accommodate the variations in wall thickness along the length of the hitting portion 118. In alternative preferred embodiments, the insert can be formed with a generally uniform inner diameter along its length and an outer diameter that varies along its length to accommodate variation in wall thickness of the insert of the present invention. In another alternative preferred embodiment, both the inner and outer diameters of the insert can be varied along their length. In another alternative preferred embodiment, the inner and/or outer diameters of the hitting portion may vary along their length to accommodate a taper formed into the shape of the bat.

This embodiment enables the wall thickness of the hitting portion 118 to be tailored or tuned to a specific application, ball-type or player. Further, the wall thickness can be matched to other factors such as the barrel length, the bat weight, and the material selected to optimize flex within the strength of the material of the bat across the entire length of the barrel (or hitting portion 118). Like the multi-wall embodiments described above, the present embodiment enables the MOI of the bat, particularly at the distal end of the bat, to be reduced thereby enabling the player to increase his or her swing speed. The present embodiment results in an enlarged sweet spot and improves the performance of the bat beyond that of conventional single-wall bats. Further, a stop-off coating can be applied to specific portions of the hitting portion 118 to allow for carburization of only specific desired locations on the hitting portion 118.

The incorporation of the variable wall thickness to the hitting portion 118 of the bat 110 further enables the use of carburized Conventional Steel by allowing for additional material and weight to be removed from various regions of the hitting portion 118. The removed material does not reduce the performance of the bat, but rather, improves the performance by reducing the MOI of the bat and optimizing the location and wall thickness of the carburized Conventional Steel. The amount of Conventional Steel needed to produce the hitting portion 118 is thereby further reduced.

Figure 8:
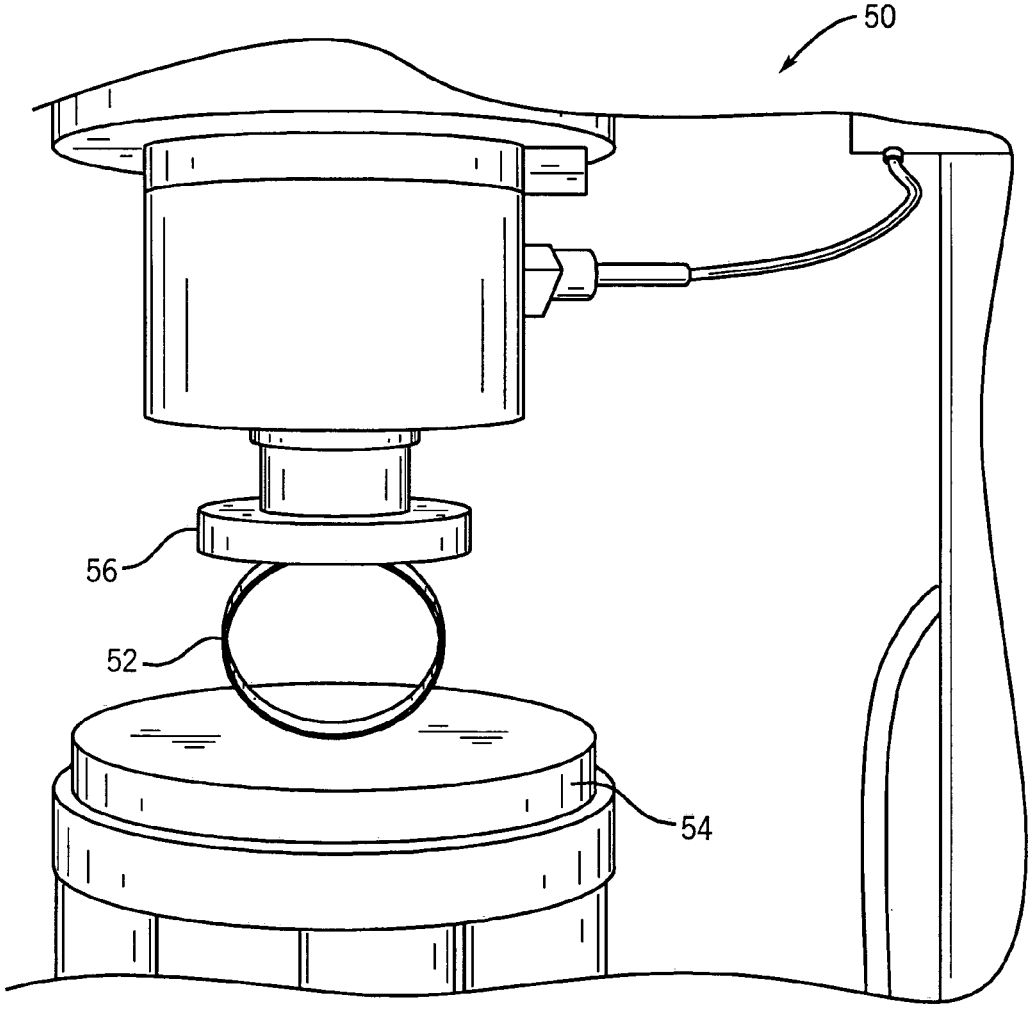
FIG. 8 is an image of yield strength test machine testing a ring of a hitting portion of a ball bat.

Referring to FIG. 8, an image of a ring load testing device 50 is illustrated. The load testing device 50 measures the deflection of a ring segment 52 from a portion of the bat 10, preferably from the central region 36 of the hitting portion 18, under an applied load 18. From the deflection and load data, the stiffness, yield strength, and modulus of elasticity can be derived. The ring segment 52 sectioned from the hitting portion 18 and placed between first and second platens 54 and 56 (or supports) on the test device 50. The ring testing device 50 is a universal test machine, or similar test machine, such as the universal test machine produced by Tinius Olsen Testing Machine Co., Inc. of Willow Grove, Pa. The first and second platens 54 and 56 provide flat support surfaces for engaging the ring section 52 during the load testing.

The ring segment 52 is aligned between the first and second platens 54 and 56, such that the longitudinal axis 14 (see FIG. 1) of the bat 10 (or the center axis of the ring) is substantially perpendicular to the direction of the load applied to the ring segment 52. The length of the ring segment 52 can be 1, 2 or 3 inches (or other dimensions) provided that the length of the ring segment 52 is less than the diameter of the first and second platens 54 and 56. The first platen 54 is fixed and positioned below the ring segment 52, and the second platen 56 is connected to the actuating unit of the test device 50. During operation, a pre-load of approximately 2–3 lbs. is applied to the ring segment 52 through the first and second platens 54 and 56 to engage the ring segment 52 between the first and second platens. The load setting is then zeroed and the load testing machine 50 is set to drive the second platen 56 downward against the ring segment 52 and the first platen 54 at a rate of 0.1 inch/min. As the first platen 54 moves downward, the load applied to, and the deflection of, the ring segment 52 is measured and graphed. The load-deflection data is then used to derive the stiffness, yield stress and modulus of elasticity of the ring segment 52. Formulas for deriving the stiffness, yield stress, strain and modulus of elasticity can be found in mechanical engineering references, such as, for example, "Formulas for Stress and Strain" by Raymond J. Roark and Warren C. Young, Fifth Edition, published by McGraw-Hill Book Company.

Table 2 below illustrates the load, deflection, stiffness, modulus of elasticity and yield strength for three carburized and tempered ring segments (Lots A–C) formed of Conventional Steel under the present invention, and a non-carburized, heat-treated Conventional Steel ring segment (Lot D). The ring segments of Lots A–D have a nominal outside diameter of 2.25 inches and a nominal wall thickness of 0.0395 inch. Lots A–C were carburized, quenched in oil, and then tempered at temperatures between 650 ad 800 deg F. for approximately 2 hours. Lot D is non-carburized and induction heat treated.

TABLE 2

| Lot | Yield Load (lbs) | Deflection at Yield Load (in) | Ring Segment Length (in) | Stiffness ((lbs/in)/in) | Modulus of Elasticity (psi) | Yield Strength (psi) | Yield Strength Pull Test (psi) |
|---|---|---|---|---|---|---|---|
| A | 190 | 0.330 | 0.925 | 693 | 28.0 × E + 6 | 277,900 | |
| B | 160 | 0.300 | 0.825 | 725 | 28.0 × E + 6 | 262,400 | |
| C | 150 | 0.275 | 0.927 | 652 | 26.0 × E + 6 | 218,900 | |
| D | 280 | 0.227 | 2.007 | 670 | 27.5 × E + 6 | 193,700 | 195,000 |

The yield strength of the carburized Conventional Steel ring segments (Lots A–C) is substantially higher than the yield strength of a heat-treated, non-carburized Conventional Steel ring segment (Lot D). As discussed above, the increased yield strength of the carburized Conventional Steel hitting portion enables a thinner wall thickness to be used, which allows for less material and improves the flexibility and "trampoline" effect of the hitting portion of the bat.

Table 3 below is a hardness profile graph of a carburized and tempered Conventional Steel ring segment. The wall thickness of the ring segment is 0.040 in. The ring segment was carburized at a 0.7% carbon potential for a carburized layer (or case depth) of 0.010 to 0.015 in on the inner and outer surface of the ring segment. The hardness scale used is a Knoop Hardness Scale in the range of 0 to 600.

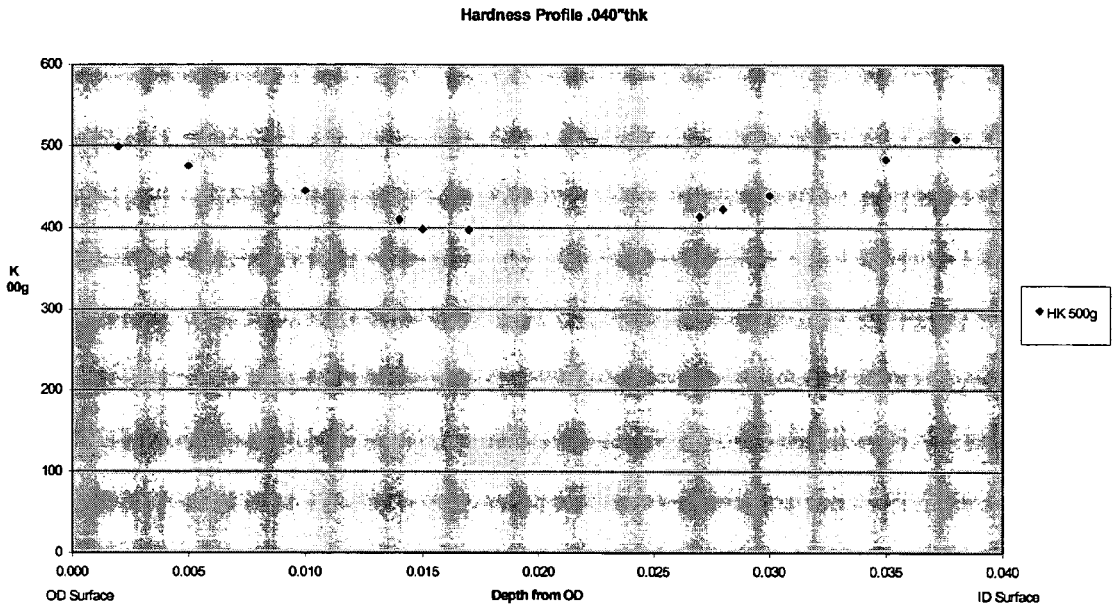
Hardness Profile .040"thk
600
500
400
300
200
100
0
K
00g
0.000
0.005
0.010
0.015
0.020
0.025
0.030
0.035
0.040
OD Surface
Depth from OD
ID Surface
HK 500g The graph of Table 3 illustrates the increased hardness of the ring segment at the inner and outer surfaces. The inner and outer surfaces have a hardness of approximately 500 on a Knoop Hardness Scale while the center of the ring segment had a lower hardness value of approximately 400 on a Knoop Hardness Scale. The inner and outer surfaces being carburized and having residual compressive stresses that increase the hardness of the inner and outer surfaces, while the middle of the ring segment remain substantially unchanged and retains its toughness and ductility. The combination of these characteristics provide for an exceptionally performing ball bat.

Figure 9:
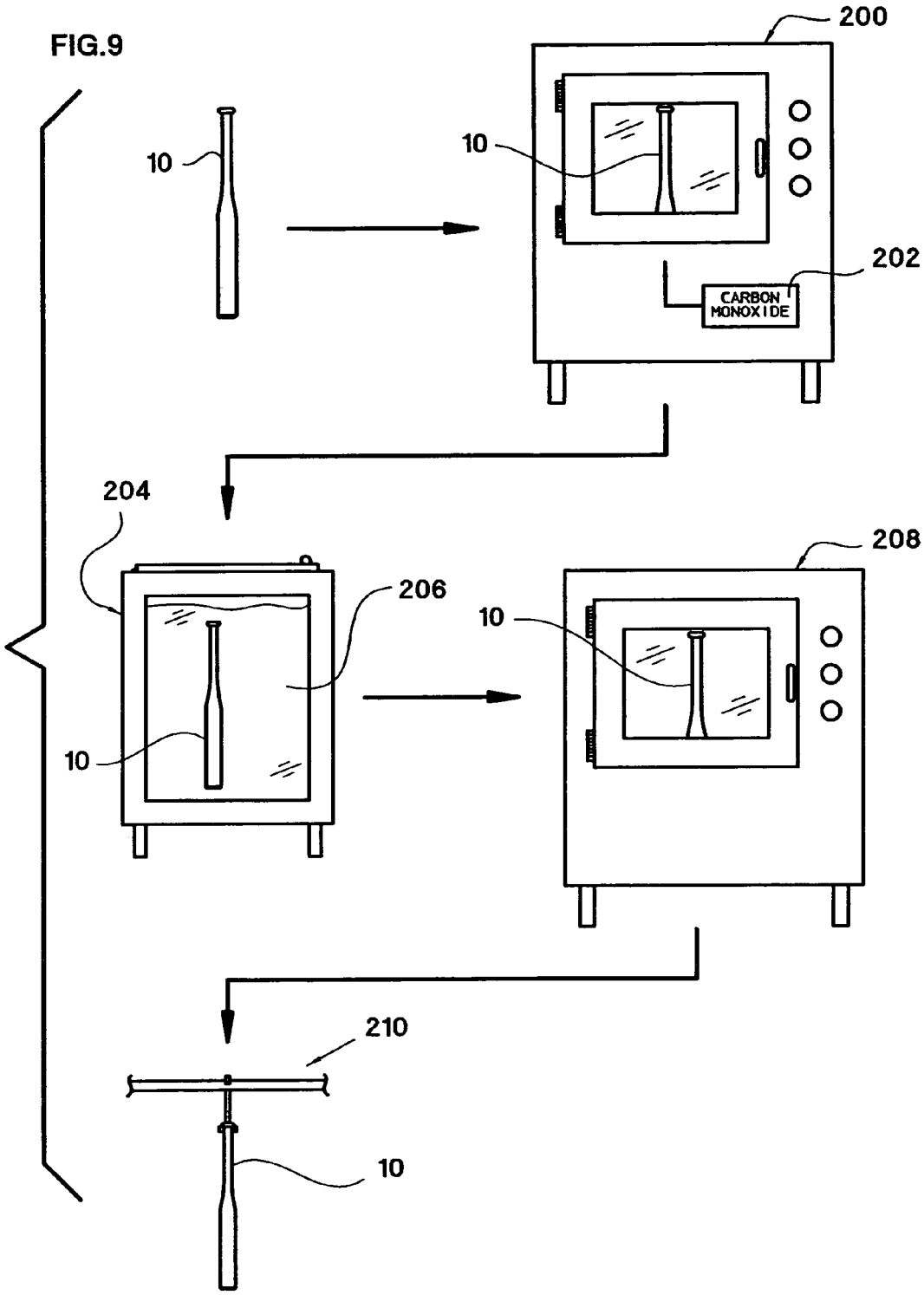
FIG. 9 illustrates producing a ball bat in accordance with a preferred method of the present invention.

Referring to FIG. 9, a method for performing the carburization of a Conventional Steel bat is illustrated. The bat 10 is formed of Conventional Steel and swaged and worked into the desired shape. The bat 10 is then placed into a furnace 200, which has been pre-heated to a temperature range of approximately 1650 to 1750 deg F. Other temperatures ranges can also be used. Higher temperatures promote more rapid carburization and therefore shorter heat treat cycles. Excessively high temperatures, however, may result in grain growth and degraded impact toughness. A tolerance of +/−25 deg F. may be used.

Carbon is then induced into the atmosphere of the furnace 200. Preferably a volume of carbon monoxide from a storage vessel 202 is introduced into the furnace atmosphere. The carbon content of the furnace atmosphere provides the driving force for carbon absorption (or diffusion) into the exposed surfaces of the bat 10 or hitting portion 18 of the bat 10. This atmosphere carbon content is referred to as carbon potential. Low carbon potentials significantly increase the time required for carburizing. Excessively high carbon potentials can result in carbide formation in the carburized layer (or case). Carbide formation would reduce impact toughness of the carburized or case hardened layer, and therefore is undesirable. In one preferred embodiment, a carbon potential range of 0.75% to 0.85% is used. This range strikes an appropriate balance between efficient carburizing and acceptable case impact toughness. In alternative preferred embodiments, other carbon potential ranges can be employed. Carburizing time also affects the depth of the carburized layer, or the case depth. The carburizing time is pre-selected for a desired case depth. In one preferred embodiment, the carburizing time is approximately 2 hours. In other alternative preferred embodiments, other durations can be used. The carburization method described above is a gas-type carburization. In alternative preferred embodiments, the carburization of the bat 10, the hitting portion 18 or a portion thereof can be performed through pack carburization, liquid carburization, vacuum carburization, or plasma (ion) carburization.

Following carburization, the bat 10 is moved to a quenching station 204 where the bat 10 is submerged into a quenching media, preferably an agitated oil 206. Alternatively, other oils or fluids (including air) can be used. In a particularly preferred embodiment, the quenching oil 206 is held at approximately 140 deg F. Rapid quenching is desired, however, too rapid of quenching can cause cracking and distortion. Quenching that is too slow will not induce the desired hardness levels of the bat 10.

Following quenching, the bat 10 is moved to another furnace 208, where it is tempered. Tempering enables the case and core hardness and impact toughness to increase. In one preferred embodiment, the tempering temperature is set within the range of 650 to 800 deg F. Alternatively, other temperatures can be used. The tempering time is also variable. In one preferred embodiment, the tempering time is approximately 2 hours. In other preferred embodiments, other durations can be used. Following tempering, the bat 10 is racked in a racking station 210 to minimize distortion.

This process can also be performed on only a portion of the bat 10 or the hitting portion 18 through use of the stop-off coating described above. In other preferred embodiments, the carburization, quenching and tempering can occur in one or more machines (furnaces or stations).

Figure 10:
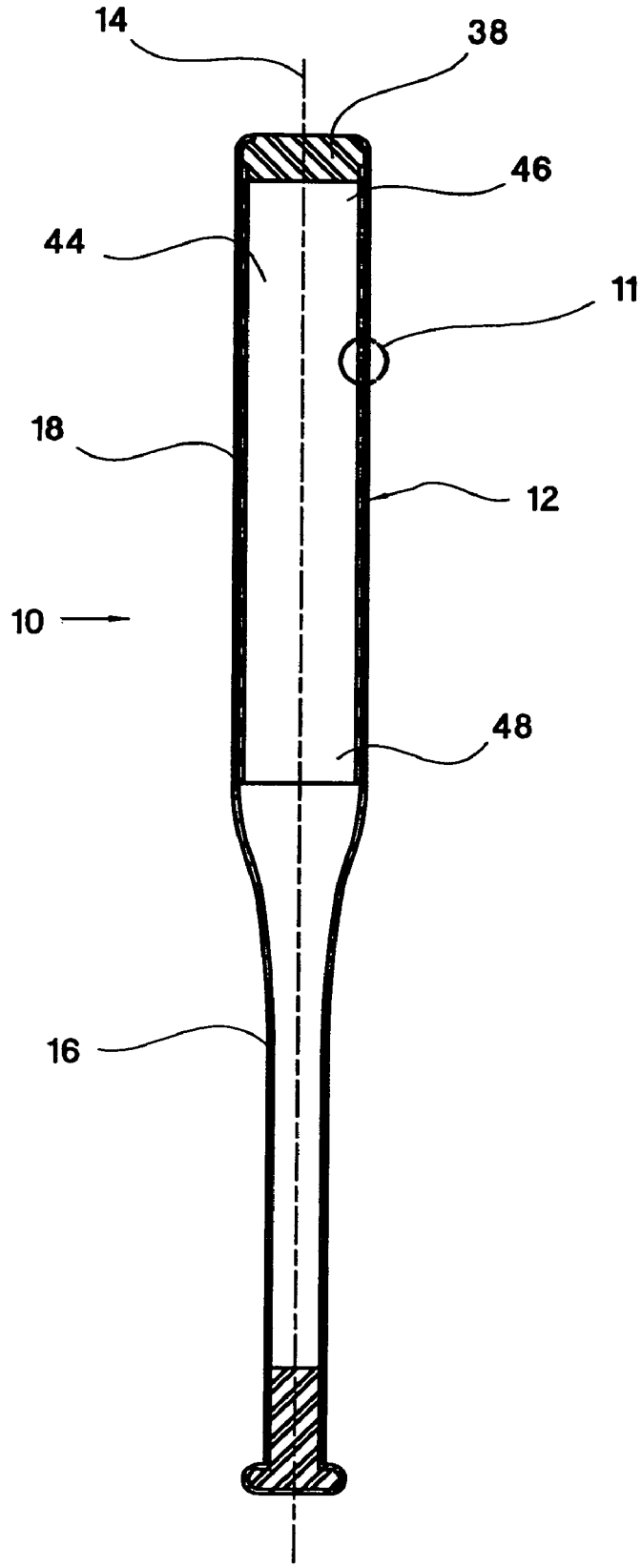
FIG. 10 is a longitudinal cross-sectional view of a bat having an insert in accordance with another alternative preferred embodiment of the present invention.

Referring to FIG. 10, in an alternative preferred embodiment, the frame 12 can include the handle portion 16 integrally formed to the hitting portion 18. The entire frame 12 or a portion thereof can be carburized under the present invention.

In another alternative preferred embodiment, the bat 10 can further include a tubular insert 44 coaxially aligned with the frame 12. The hitting portion 18 is preferably configured to receive the insert 44. A distal end of the hitting portion 18 is preferably curled inward to retain the insert 44, and the end cap 38 is attached to a distal region of the hitting portion 18 to substantially enclose the distal end of the bat 10. The insert 44 is a cylindrical structure preferably sized to extend within and along a significant portion of the hitting portion 18 of the frame 12. The insert 44 has opposing distal and proximal ends 46 and 48, that preferably engage the frame 12. Such engagement inhibits axial movement of the insert 44 within the frame 12.

The insert 44 is positioned within the frame 12 such that the insert 44 is capable of moving independently with respect to the frame 12 upon impact of the bat with a ball. This independent movement enables the insert 44 and the frame 12 to function during use with the characteristics of a leaf spring.

Figure 11:
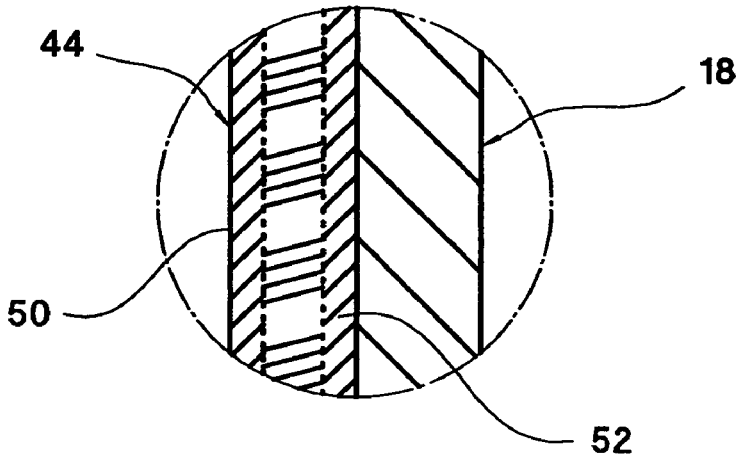
FIG. 11 is an expanded view of the hitting portion of the bat and the insert taken from circle 11 of FIG. 10.

In this alternative preferred embodiment, the frame 12 is formed of a high strength, lightweight material, such as aluminum. Alternatively, other materials can also be used such as composite materials. The insert 44 is formed of carburized and tempered Conventional Steel. The carburized Conventional Steel of the insert 44 includes the same attributes as the Conventional Steel for the hitting portion 18 described above. FIG. 11 illustrates the insert 44 having both its inner and outer surfaces carburized such that inner and outer carburized layers 50 and 52 are formed within the insert 44. The characteristics of the insert 44 and the carburized layers 50 and 52 are substantially similar to those of the bat 10 and hitting portion 18 described above. In other alternative preferred embodiments, a stop-off coating can be used such that only a portion of the insert 44 is carburized.

Figure 12:
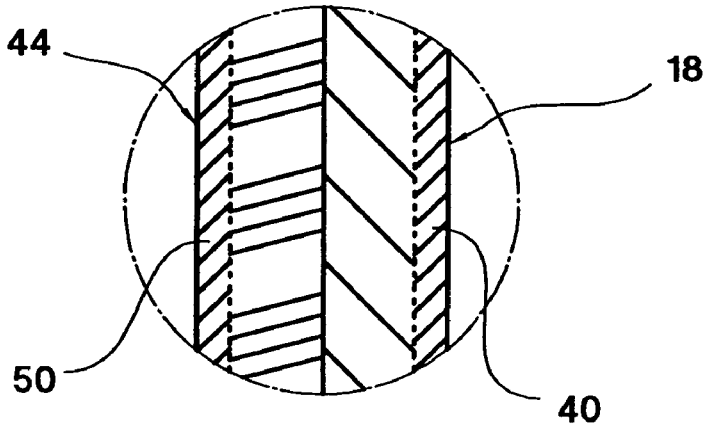
FIG. 12 is an expanded view of the hitting portion of the bat and the insert illustrating an alternative preferred embodiment of the present invention

Referring to FIG. 12, in another alternative preferred embodiment, the hitting portion 18 and the insert 44 can each be formed of carburized Conventional Steel. In FIG. 12, the insert 44 includes the inner carburized layer 50 and the hitting portion 18 includes the outer carburized layer 40. Other variations or combinations of carburized layers can be used on the hitting portion 18 and the insert 44.

In alternative preferred embodiments, the Conventional Steel bat or hitting portion can be nitrided in lieu of being carburized. Nitriding, which involves diffusing or impregnating nitrogen into the exposed surface(s) of the Conventional Steel, can be performed using gas, pack, liquid, pressure, vacuum or plasma. Boriding, which involves diffusing boron into the exposed surface or surfaces of a Conventional Steel, is another alternative treatment for the Conventional Steel bat contemplated under the present invention. Boriding can be accomplished through gas, liquid, paste, plasma vapor deposition or chemical vapor deposition. Nitriding and boriding achieves similar advantages as described above for carburized Conventional Steel. Further nitriding and boriding are accomplished in a similar manner as described above for carburization. Thermoreactive treatment whereby carbon and nitrogen are added to the bat or hitting portion is also contemplated under the present invention.

While there have been illustrated and described preferred embodiments of the present invention, it should be appreciated that numerous changes and modifications may occur to those skilled in the art and it is intended in the appended claims to cover all of those changes and modifications which fall within the spirit and scope of the present invention.

What is claimed is:

1. A ball bat comprising:

a substantially tubular frame including, a handle portion formed of a non-steel material, and a hitting portion formed separately from, and coupled to, the handle portion, the hitting portion being formed substantially of a non-maraging steel and having a length, one intermediate tubular region positioned between first and second tubular wall transition regions, an inner surface and an outer surface, the wall thickness of the hitting portion varying longitudinally and being generally uniform circumferentially, the wall thickness of the hitting portion being greatest at the intermediate tubular region, the wall thickness of the first and second tubular transition regions being less than the greatest wall thickness of the intermediate tubular region, at least a portion of hitting portion being carburized forming a carburized layer, the hitting portion overlapping the remainder of the frame by an amount that is less than one half of the length of the hitting portion.

2. The bat of claim 1, wherein the carburized layer extends over at least a portion of the inner surface of the hitting portion.

3. The bat of claim 1, wherein the carburized layer extends over at least a portion of the outer surface of the hitting portion.

4. The bat of claim 1, wherein the carburized layer extends over at least a portion of the inner and outer surfaces of the hitting portion.

5. The bat of claim 1, wherein the hitting portion has a thickness within the range of 0.035 to 0.075 inches.

6. The bat of claim 5, wherein the thickness of the hitting portion is within the range of 0.040 to 0.065 inches.

7. The bat of claim 5 wherein at least a portion of the hitting portion is through wall carburized such that the thickness of the carburized layer extends from the inner surface to the outer surface.

8. The bat of claim 1, wherein the depth of the carburized layer is within the range of 0.002 to 0.020 inches.

9. The bat of claim 8, wherein the depth of the carburized layer is within 0.008 to 0.017 inches.

10. The bat of claim 1, wherein at least a portion of the handle portion directly contacts at least a portion of the hitting portion.

11. A ball bat having a longitudinal axis and capable of being tested in a ring load testing device having first and second platens, the bat comprising:

a substantially tubular frame having a handle portion formed separately from a primary hitting portion, the hitting portion being formed substantially of one of a conventional non-maraging carbon steel and a high strength, low alloy non-maraging steel, the hitting portion having an inner surface, an outer surface, and a single central region positioned between first and second tubular wall transition regions, the wall thickness of the hitting portion varying longitudinally and being generally uniform circumferentially, the wall thickness of the hitting portion being greatest at the central region with a wall thickness of at least 0.030 inches to less than 0.065 inches, the wall thickness of the first and second tubular wall transition regions being less than the greatest wall thickness of the central region, at least a portion of the inner surface or the outer surface of the hitting portion being carburized forming a carburized region, and the hitting portion having a yield strength within the range of 200 and 300 ksi when a ring of a predetermined length is removed from the central region of the hitting portion and placed between the first and second platens of the ring load testing device, the first platen applying a load to an outer circumferential surface of the ring in a direction that is substantially perpendicular to the longitudinal axis.

12. The bat of claim 11, wherein the thickness of the central region of the hitting portion is within the range of 0.035 to 0.047 inches.

13. The bat of claim 11, wherein the yield strength of the hitting portion is within the range of 210 to 280 ksi.

14. The bat of claim 11, wherein the handle portion is coupled to the hitting portion, and wherein the hitting portion overlaps the handle portion by an amount that is less than one half of the length of the hitting portion.

15. The bat of claim 11, wherein the handle portion is made of a non-composite material.

16. The bat of claim 15, wherein the non-composite material is a steel.

17. A single-walled ball bat comprising:

a substantially tubular frame having a handle portion formed separately from a primary hitting portion, the hitting portion being formed substantially of a non-maraging steel, the hitting portion having a first wall thickness, an inner surface and an outer surface, the first wall thickness being within the range of 0.030 inches to 0.047 inches at least a portion of hitting portion forming a high performance layer formed of one of carburizing and nitriding, the high performance layer having a hardness within the range of 80 to 93 on a 15N Rockwell Hardness Scale, and the high performance layer having a second thickness that is at least 5% of the first thickness and less than 100% of the first thickness, the single-walled ball bat formed without a separate tubular member coaxially aligned with the hitting portion of the frame.

18. The bat of claim 17, wherein the higher performance layer is a layer of carburized steel that extends over at least a portion of the inner surface of the hitting portion.

19. The bat of claim 17, wherein the higher performance layer is a carburized layer that extends over at least a portion of the outer surface of the hitting portion.

20. The bat of claim 17, wherein the higher performance layer is a carburized layer that extends over at least a portion of the inner and outer surfaces of the hitting portion.

21. The bat of claim 17, wherein the second thickness is at least 25% of the first thickness.

22. The bat of claim 17, wherein the thickness of the hitting portion is generally uniform along the length of the hitting portion.

23. The bat of claim 17, wherein the hitting portion includes a single central region positioned between first and second tubular wall transition regions, wherein the wall thickness of the hitting portion varies longitudinally and is generally uniform circumferentially, wherein the wall thickness of the hitting portion is greatest at the central region, and wherein the wall thickness of the first and second tubular wall transition regions is less than the greatest wall thickness of the central region.

24. The bat of claim 17, and wherein the handle portion is coupled to the hitting portion.

25. The bat of claim 17, wherein the steel is a conventional carbon steel.

26. The bat of claim 17, wherein the steel is an alloy steel.

27. The bat of claim 17, wherein the steel is a high strength low alloy steel.

* * * * *